US005419566A

United States Patent [19]

Byrd

[11] Patent Number: 5,419,566

[45] Date of Patent: May 30, 1995

[54] SMALL DISC TOSS GAME

[76] Inventor: Kenneth W. Byrd, 2402 N. Main St., Tarboro, N.C. 27886

[21] Appl. No.: 320,878

[22] Filed: Aug. 15, 1994

[51] Int. Cl.[6] ..... A63B 67/06

[52] U.S. Cl. ..... 273/402

[58] Field of Search ..... 273/398, 399, 400, 401, 273/402, 336

[56] References Cited

U.S. PATENT DOCUMENTS

| | | | |
|---|---|---|---|
| 501,844 | 7/1893 | Pettersch | 273/399 |
| 712,159 | 10/1902 | Voege | 273/400 |
| 1,114,523 | 10/1914 | Revell | 273/398 X |
| 3,107,095 | 10/1963 | Cairns | 273/398 |
| 5,318,307 | 6/1994 | Bouchard et al. | 273/400 X |

*Primary Examiner*—William H. Grieb

[57] ABSTRACT

Small Disc Toss Game, which comprises of small discs tossed toward a score zone and a bonus score tube, of specific measurements, placed flat on the ground. The bonus tube is inserted with a protective flanged shelve to keep bonus tube from chipping and to serve as a target. The bonus tubes and score zones are secured to the ground with small anchors. The game consist of opposing score zones and bonus tubes placed at a specific distance apart and each score zone is used as boundary lines. All persons taking part in the game are referred to as player or players. Discs are tossed toward opposing score zones and bonus tubes for the propose of scoring the highest amount of points. The first player or players to reach the set number for winning the game, will be the winner.

8 Claims, 2 Drawing Sheets

SMALL DISC TOSS GAME

SUMMARY OF THE INVENTION

The Small Disc Toss Game of the present invention comprises of small discs tossed toward a score zone and a bonus score tube, of specific measurements, placed flat on the ground. The bonus score tube is inserted with a protective flanged shelve to keep the tube from being chipped and is also used as a target. The bonus score tube and score zone are secured to the ground with small anchors at strategic areas. There are opposing score zones placed at a specific distance apart in a straight line and each score zone is used as boundary lines. All persons taking part in the game are referred to as player or players. Small discs are tossed toward opposing score zones for the propose of scoring the highest amount of points. The first player or players to reach the set number for winning the game will be the winner.

DETAILED DESCRIPTION OF INVENTION

Figure 1:
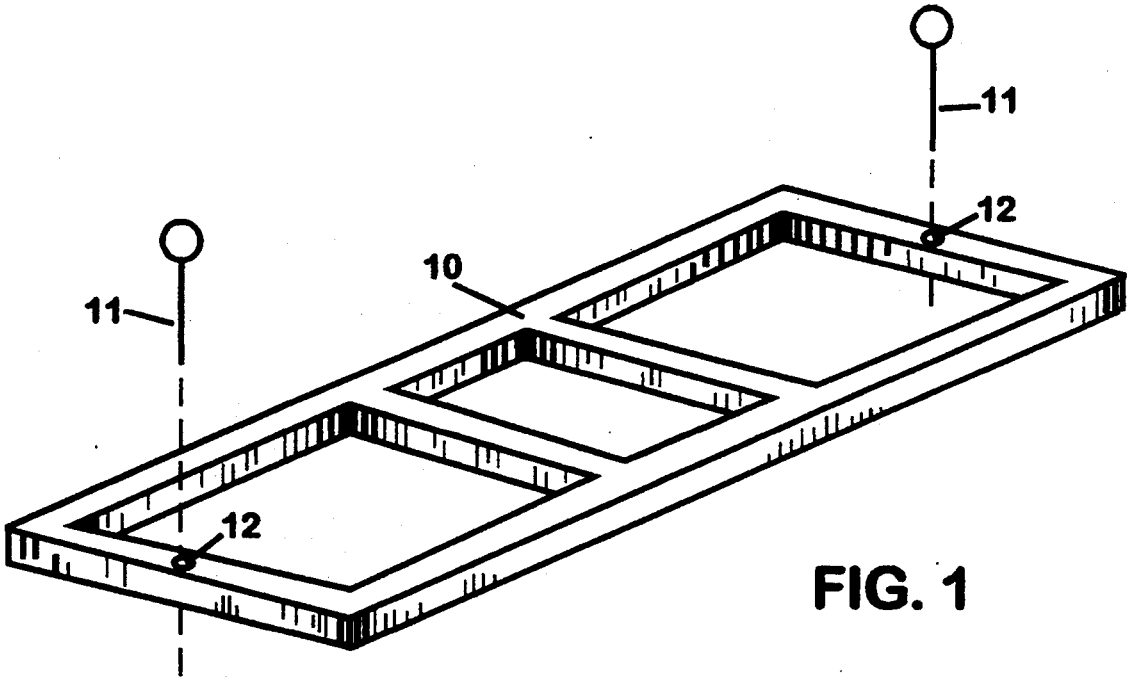
FIG. 1 is a perspective view of a score zone with anchor holes on each end and anchors.

Having reference to the drawings, FIG. 1 illustrates a rectangular score zone 10 made of a light weight material of specific size and measurements. Score zones measure 48 inches in width and 12 inches in depth with a 5 inch bonus score section in the center of score zone 10. Each score zone 10 has designated small holes 12 measuring ⅛ inch in diameter on each side of score zone 10 used for anchoring. Metal anchors 11 measuring 6 inches in length are used to secure the score zone 10 to the ground. FIG. 1

Figure 2:
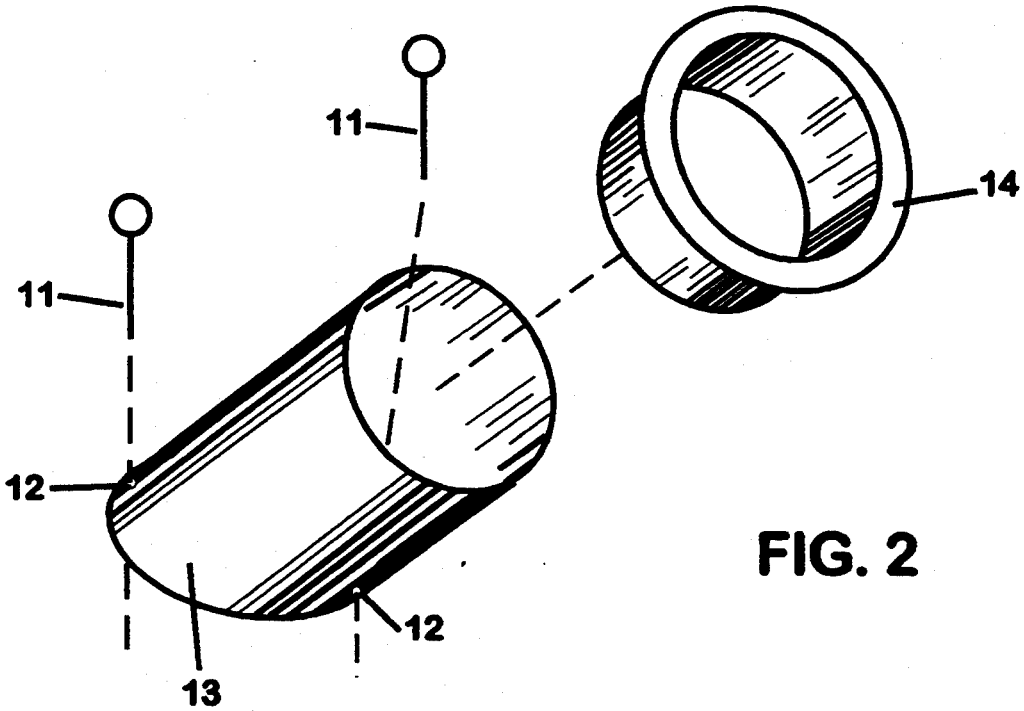
FIG. 2 is a perspective view of a bonus score tube with anchors and protective ornamental target ring.
Figure 3:
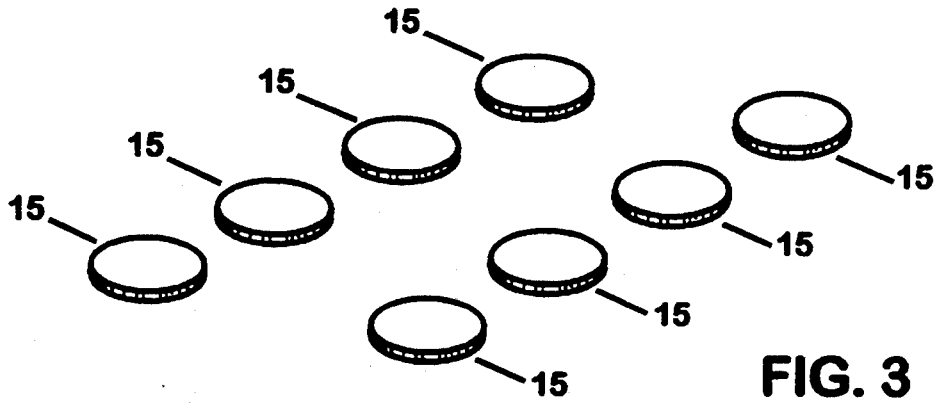
FIG. 3 is a perspective view of round discs used for tossing toward score zones and bonus score tubes for the propose of scoring the highest amount of points.

The bonus score tube 13 FIG. 2 is used for awarding bonus points when it has been rung by player or players with discs 15 FIG. 3 from a predetermined distance of 26 feet at a straight line from opposite score zone 10 and bonus tube 13. Each bonus tube measures 6 inches in diameter cut to a angle of 35 degrees on bottom of tube and is inserted with a protective flanged ornamental target 14 FIG. 2 that is a slightly smaller diameter of 5 ⅞ inch so it will slide inside of top of bonus tube 13. Bonus tube 13 is secured to the ground with ⅛ inch diameter 6 inch long metal anchors 11 placed through ⅛ inch holes 12 FIG. 2 at bottom of bonus tube 13 at strategic points at front and back of tube.

Figure 4:
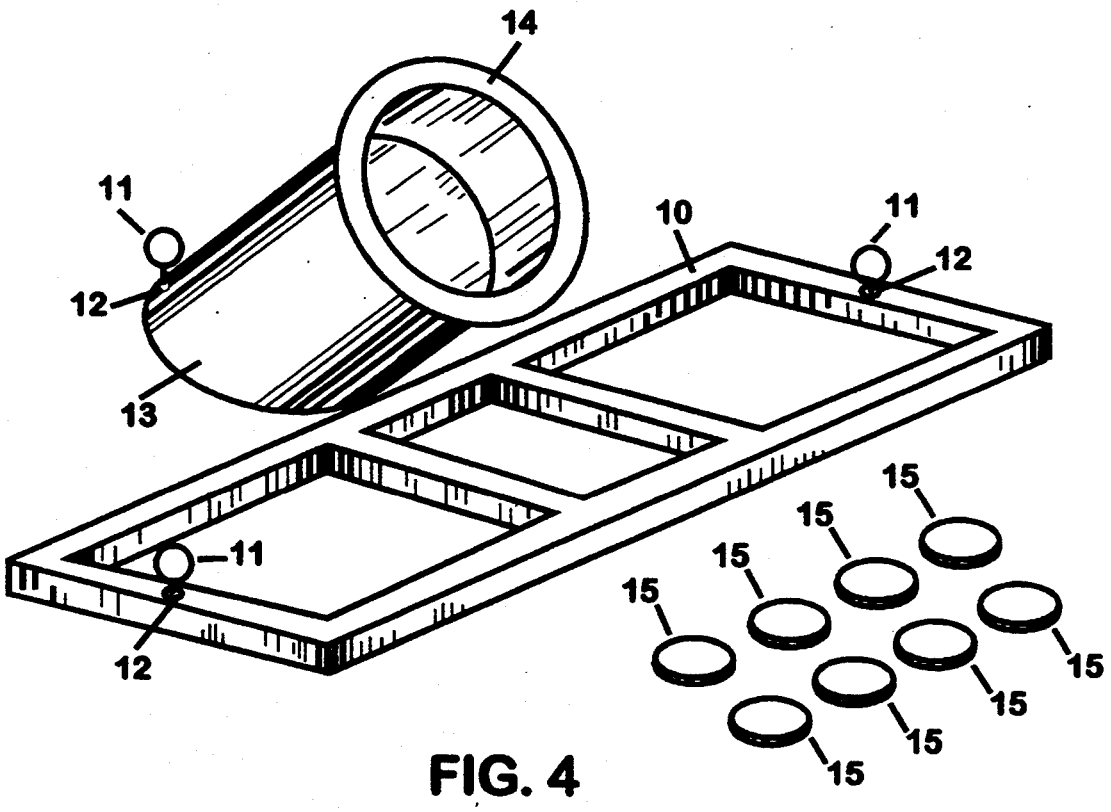
FIG. 4 is perspective view of the disc toss game as would appear on a flat surface.

The bonus tube 13 is placed directly behind score zone 10 at a center point of the small scoring area in the center of score zone 10 FIG. 4. Components comprising of score zone 10: bonus tube 13: protective flanged target 14 and anchors 11, are placed on flat ground or grass. The opposite components of the same are anchored 11 FIG. 4 at a specified distance of 26 feet apart following a straight line. After putting in place on ground, the back of score zones 10 are the boundary lines for the tossing of each disc 15 by player or players, not to cross the boundary with the player or players forward moment.

Discs 15 FIG. 3 are 2 inch diameter ⅛ inch thick steel metal that weigh two ounces each. Each player is issued four discs 15 of a different color from opponent. With each players turn to score, the player tosses four discs, one at a time toward the opposite score zone 10 and bonus tube 13 FIG. 4 with a chance of scoring a point or points. To score, the disc must be within the scoring zone 10 and closest to the inside edge of the back of score zone 10. The closest disc wins over all other discs 15 within the score zone 10. The disc does not count if it crosses pass back edge of score zone 10. Neither does disc 15 score if it lands on or touches any part of score zone 10. The disc 15 has to be within the boundaries of the score zone 10 to score point or points. Multiple points can be won with four tosses if player has more than one disc closer to the back inside edge of score zone 10 than opponent, and the discs are in the score zone 10. There are three score areas in the score zone 10 in front of the bonus tube 13 FIG. 4. Left and right larger areas in score zone 10 are one point zones and the small area in the middle of score zone 10 is a two point area. The bonus tube 13 is a bonus of five points. Ringer bonus tube points can be canceled out with the ringer of the opponent. The score zone 10 points are counted separate from bonus tube 13 points. A player can score points in the score zone 10 while the opponent scores bonus tube 13 points. Object of game is to reach the determined points of 20 and first player or players to do so will be the winner of game.

I claim as my invention:

1. A tossing game in which two or four players take turns tossing pieces that identify each player;

said game being comprised of a rectangle and round tube reception frames, said rectangle divided into three zones of different size, and playing pieces to be tossed into said zones and tube;

the playing pieces of each player being of one category, all being of the same size and weight;

the tossing of the pieces in said zones or tube by definition of the rules, permitting to enter tube or occupy closest spot to scoring point in said zones.

2. A game as described in claim 1 wherein said ability to remove pieces is carried out by the players themselves.

3. A game as described in claim 1 wherein the pieces assigned to each player are identified by two (2) different colors; there are four (4) pieces per player; pieces being same size and thickness.

4. A game as described in claim 3 wherein the size of the pieces permits to fit eight (8) pieces in rectangular and tube zones.

5. A game as described in claim 1 wherein said zones comprise borders made of hard material.

6. A game as described in claim 5 wherein said borders comprise of hard material to retain said projectiles.

7. A game as described in claim 1 wherein said round tube zone comprise borders of six times the height of said rectangular zone.

8. A tossing game in which two or four players take turns tossing pieces that identify each player;

said game being comprised of a rectangular and bonus round tube reception frames, said rectangular frame divided into three zones, and playing pieces to be tossed into said zones;

the playing pieces of each player being of one category, all projectiles being the same size and color;

the tossing of the projectiles in said zones permitting to complete the accumulation of points by definition of the rules, the the first to reach winning points will be the winner of the game.

* * * * *